US010912434B2

(12) United States Patent
De Wit

(10) Patent No.: US 10,912,434 B2
(45) Date of Patent: Feb. 9, 2021

(54) VACUUM CLEANER HEAD

(71) Applicant: KONINKLIJKE PHILIPS N.V., Eindhoven (NL)

(72) Inventor: Bastiaan Johannes De Wit, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 203 days.

(21) Appl. No.: 15/766,108

(22) PCT Filed: Oct. 26, 2015

(86) PCT No.: PCT/EP2015/074723
§ 371 (c)(1),
(2) Date: Apr. 5, 2018

(87) PCT Pub. No.: WO2017/071727
PCT Pub. Date: May 4, 2017

(65) Prior Publication Data
US 2018/0289226 A1 Oct. 11, 2018

(51) Int. Cl.
*A47L 9/04* (2006.01)

(52) U.S. Cl.
CPC ..... *A47L 9/0405* (2013.01); *A47L 9/0477* (2013.01)

(58) Field of Classification Search
CPC ..... A47L 5/30; A47L 9/0477; A47L 9/0411; A47L 9/04; A47L 5/34; A47L 9/0405; A47L 9/0422; A47L 9/0427; A47L 9/0433; A47L 9/0438
See application file for complete search history.

(56) References Cited

U.S. PATENT DOCUMENTS

| | | | | |
|---|---|---|---|---|
| 1,694,937 A | | 12/1928 | Floeter | |
| 2,642,617 A | * | 6/1953 | Lilly | A47L 11/40 15/388 |
| 4,357,727 A | | 11/1982 | McDowell | |
| 5,018,240 A | | 5/1991 | Holman | |
| 5,090,084 A | | 2/1992 | De Guzman | |

(Continued)

FOREIGN PATENT DOCUMENTS

| | | |
|---|---|---|
| CN | 2314726 Y | 4/1999 |
| CN | 202960388 U | 6/2013 |

(Continued)

*Primary Examiner* — Robert J Scruggs

(57) ABSTRACT

The present application relates to a vacuum cleaner head (10). The vacuum cleaner head (10) includes a housing (40) having a vacuum extraction zone (49), and first and second rollers (20, 30) configured to locate against a surface to be cleaned (60). Each of the first and second rollers (20, 30) is able to pick-up detritus from the surface to be cleaned (60) when they rotate and move over the surface (60) and to carry detritus to the vacuum extraction area (49) in the housing (40). In accordance with the present invention, the first roller (20) is rotatable when moved along the surface to be cleaned (60) in a first direction and restricted from rotating when moved in an opposing second direction. The second roller (30) is rotatable when moved along the surface to be cleaned (60) in the second direction and restricted from rotating when moved in the first direction. The present application also relates to a vacuum cleaner comprising the vacuum cleaner head (10).

20 Claims, 2 Drawing Sheets

(56) References Cited

U.S. PATENT DOCUMENTS

| | | | | |
|---|---|---|---|---|
| RE35,033 | E | 9/1995 | Waldhauser | |
| 5,873,014 | A * | 2/1999 | Knapp | G03G 15/11 15/256.52 |
| 7,665,172 | B1 * | 2/2010 | Tran | A47L 11/24 15/41.1 |
| 9,144,356 | B2 * | 9/2015 | Yun | A47L 9/0483 |
| 9,468,347 | B2 * | 10/2016 | Bradbury | A47L 13/44 |
| 9,693,663 | B2 * | 7/2017 | Kasper | A47L 9/0477 |
| 2001/0042282 | A1 * | 11/2001 | Sjogreen | A47L 9/0477 15/322 |
| 2006/0075596 | A1 | 4/2006 | Bosses | |
| 2012/0284950 | A1 * | 11/2012 | De Wit | A47L 11/34 15/320 |
| 2014/0109338 | A1 * | 4/2014 | Jang | A47L 11/4069 15/340.3 |
| 2014/0259475 | A1 | 9/2014 | Doughty | |
| 2015/0150364 | A1 * | 6/2015 | Gafford | A46B 3/00 15/186 |

FOREIGN PATENT DOCUMENTS

| | | | |
|---|---|---|---|
| DE | 1226681 | A1 | 2/1994 |
| GB | 2159393 | A | 12/1985 |
| JP | 02203829 | * | 8/1990 |
| WO | 2014094833 | A1 | 6/2014 |
| WO | 2014140935 | A2 | 9/2014 |

* cited by examiner

VACUUM CLEANER HEAD

This application is the U.S. National Phase application under 35 U.S.C. § 371 of International Application No. PCT/EP2015/074723, filed on Oct. 26, 2015. This application is hereby incorporated by reference herein.

FIELD OF THE INVENTION

The present application relates to a vacuum cleaner head. The present application also relates to a vacuum cleaner including the vacuum cleaner head.

BACKGROUND OF THE INVENTION

GB 2 159 393 discloses a suction nozzle suitable for use in removing liquid from wet ground surfaces such as tennis courts. The nozzle comprises two spaced rolls which are accommodated in a housing and partly project therefrom.

Vacuum cleaners are known for removing detritus from a surface to be cleaned, such as a floor. Floors may be defined as 'hard surfaces' and 'soft surfaces'. Soft surfaces include carpets. Hard surfaces include tiles, linoleum, and wooden flooring among others.

Generally, a vacuum cleaner has a vacuum cleaner head which forms a base of the vacuum cleaner, for example a stick or upright vacuum cleaner. A suction force is formed in the head that draws detritus from the surface to be cleaned to a suction opening through which detritus is removed from the head. Rotating brushes or rollers are used to help dislodge detritus from the surface to be cleaned and direct it to the suction opening. The brushes or rollers are rotated at a high rotational velocity so as to impart a velocity on detritus and direct it towards the suction opening.

SUMMARY OF THE INVENTION

It is an object of the invention to provide an improved vacuum cleaner head and/or a vacuum cleaner. The invention is defined by the independent claims; the dependent claims define advantageous embodiments.

According to the present invention, there is provided a vacuum cleaner head comprising a housing having a vacuum extraction zone, first and second rollers configured to locate against a surface to be cleaned, each of the first and second rollers being configured to pick-up detritus from the surface to be cleaned and carry detritus to the vacuum extraction zone in the housing when they rotate and move over the surface. In accordance with the present invention, the first roller is rotatable when moved along the surface to be cleaned in a first direction and restricted from rotating when moved in an opposing second direction, and the second roller is rotatable when moved along the surface in the second direction and restricted from rotating when moved in the first direction.

With this arrangement it is possible to carry detritus from the surface to be cleaned to the vacuum extraction zone so that the detritus is removed. The leading, rotating roller is able to move over and pick-up detritus on the surface to be cleaned so that it is transported to the vacuum extraction zone. The trailing, non-rotating roller restricts detritus on the section of the surface to be cleaned that the head has passed over from passing out from under the head. Therefore, detritus is either retained between the rollers as the head is maneuvered, or is drawn to the vacuum extraction zone. The trailing, non-rotating roller also acts to wipe the surface to be cleaned and so helps to remove smaller detritus elements.

When the direction of movement is reversed the trailing, non-rotating roller becomes the leading, rotating roller, and so detritus that has located against said roller is picked-up and carried towards the vacuum extraction zone due to the rotation of that roller. Loose detritus may also be caught by the airstream created between the rollers, and be drawn to the vacuum extraction zone between the rollers. The airstream is formed due to the vacuum created in the vacuum extraction zone creating a pressure difference which causes the flow of air towards the vacuum extraction zone.

The vacuum cleaner head may further comprise a detritus removal arrangement in the housing which is configured to act on at least one of the first and second rollers to promote removal of the detritus from the at least one of the first and second rollers to the vacuum extraction zone as the at least one of the first and second rollers rotates. Due to the above, it is possible to provide assistance to remove detritus from the rotating roller that has been picked-up and carried by the roller. Therefore, further detritus removal is provided in addition to removal due to suction. This helps with detritus removal and helps to prevent a need to clean the at least one roller.

The detritus removal arrangement may be configured to promote removal of dust and/or particles from the at least one of the first and second rollers as the at least one of the first and second rollers rotates. Therefore, dust and particles accumulating on the at least one roller may be removed from the at least one roller.

The detritus removal arrangement may comprise a plurality of resilient elements configured to act on the at least one of the first and second rollers. With this arrangement, detritus may be provided with an urging force to promote the removal of the detritus from the at least one roller. Therefore a vacuum provided at the vacuum extraction zone may be minimized. Furthermore, the resilient elements help to maintain contact with the at least one roller, and aid in preventing detritus from accumulating on the detritus removal arrangement or on the at least one roller.

The plurality of resilient elements may be bristles. Therefore, it is possible to easily provide a multitude of resilient elements, and to provide a detritus removal arrangement that covers the length of the at least one roller whilst maintaining a flow of air therethrough.

The vacuum cleaner head may further comprise a liquid removal arrangement in the housing configured to act on at least one of the first and second rollers to promote removal of liquid from the at least one roller to the vacuum extraction zone. With this arrangement it is possible to promote the passage of a liquid from the roller. Therefore, it is possible to promote the removal of liquid from the roller and then extraction of the liquid from the vacuum cleaner head.

The liquid removal arrangement may comprise a resilient flap configured to act on the at least one of the first and second rollers. This means that it is possible to easily remove liquid from the at least one roller and direct it to the vacuum extraction zone.

The liquid removal arrangement and detritus removal arrangement may be integrally formed. Therefore, the number of components may be minimized and both detritus and liquid may be removed.

The first roller and the second roller may be configured to be urged to rotate due to the action of the vacuum cleaner head being moved over the surface to be cleaned. With this arrangement it is not necessary to provide any drive means to rotate the rollers as rotation is caused by the linear motion applied to the vacuum cleaner head. Therefore, energy efficiency is maximized. Furthermore, the size of the head may be minimized.

An outer layer of the at least one of the first and second rollers may be fibrous. This means that the efficiency of the at least one roller at picking up detritus may be maximized. Furthermore, the detritus may be easily released from the at least one roller.

A layer of at least one of the first and second rollers may be configured to retain liquid. This means that the efficiency of the at least one roller at picking up liquid may be maximized. Furthermore, the liquid may be easily released from the at least one roller.

At least a section of at least one of the first and second rollers may be resilient. Therefore, it is possible for the at least one roller to compensate for adjustments in the height of the surface to be cleaned. For example, recesses and protrusions may be compensated for. The resilience of the roller means that a section of the outer surface of the roller is slightly flattened in contact with the surface to be cleaned. The ability of the at least one roller to pick up wet or stuck detritus particles on the surface to be cleaned may be enhanced by the micro-slip effect on the surface due to the flattening of the brush on the floor. Micro-slip occurs due to the rolling contact between the roller, acting as a cylindrical body, and the surface to be cleaned, acting as a planer body to cause local relative sliding between particles of the contacting bodies.

A support for supporting at least one of the first and second rollers may be spaced from at least one end of the at least one of the first and second rollers. This means that it is possible for the end of the at least one roller to be positioned against an upstanding element on the surface to be cleaned, and therefore maximize the extent of the surface that the head is able to reliably clean. For example the end of the at least one roller may extend from the body. Furthermore, the number of supports required to support the at least one roller may be minimized.

The vacuum cleaner head may further comprise a liquid dispenser to dispense a liquid onto the surface to be cleaned. The vacuum cleaner head may further comprise a liquid dispenser to dispense a liquid onto at least one of the first and second rollers. Therefore, it is possible to dampen a surface to be cleaned to promote the removal of detritus from the surface.

According to another aspect of the present invention, there is provided a vacuum cleaner comprising a vacuum cleaner head as described above.

These and other aspects of the invention will be apparent from and elucidated with reference to the embodiments described hereinafter.

BRIEF DESCRIPTION OF THE DRAWINGS

Embodiments of the invention will now be described, by way of example only, with reference to the accompanying drawings, in which.

DETAILED DESCRIPTION OF EMBODIMENTS

Figure 1:
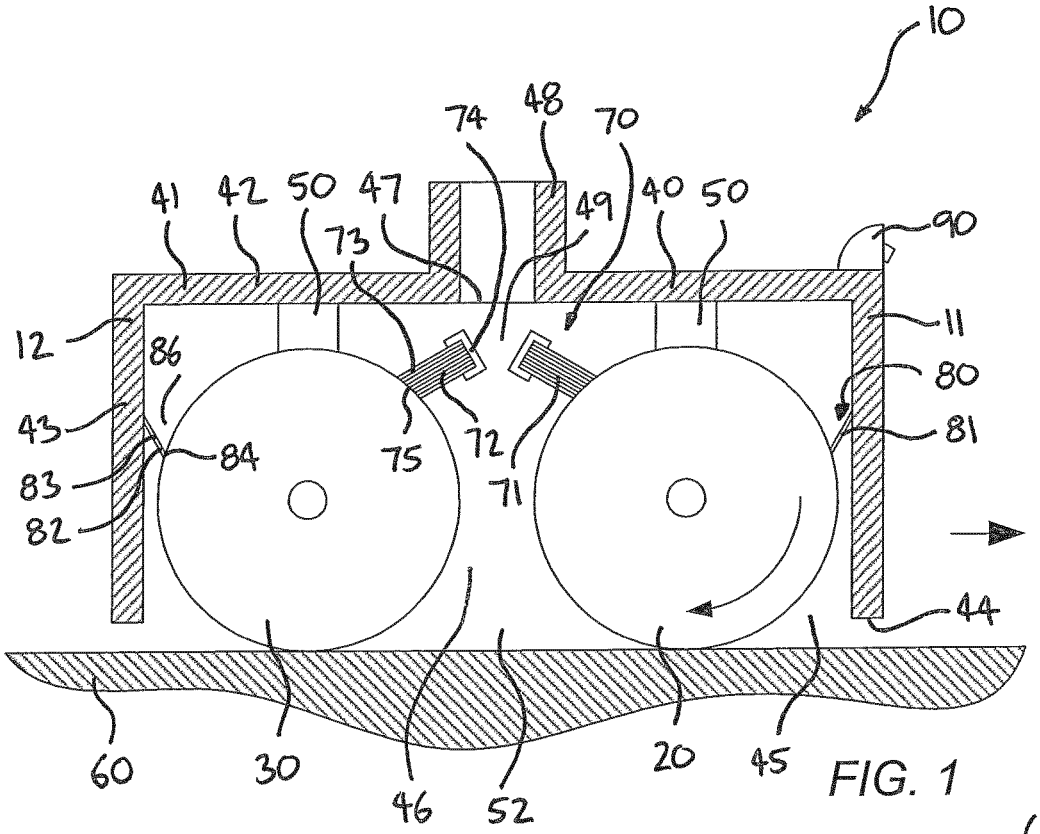
FIG. 1 shows an illustrative partial cutaway side view of a vacuum cleaner head according to an embodiment of the present invention urged in a first direction along a surface to be cleaned, with a section of a housing of the head omitted.

Referring now to FIGS. 1 to 4, a vacuum cleaner head 10 is shown. The vacuum cleaner head 10 forms part of a vacuum cleaner (not shown). In this embodiment, the vacuum cleaner head 10 is integrally formed with the remainder of the vacuum cleaner, however it will be understood that the vacuum cleaner head may be independent from the remainder of the vacuum cleaner. The embodiment described below is generally for use on a hard surface.

The vacuum cleaner head 10 has a front end 11 and a rear end 12. The front end 11 of the vacuum cleaner head 10 forms a leading edge, and the rear end 12 forms a trailing edge, when the vacuum cleaner head 10 is pushed in a forwards direction (left-to-right in FIGS. 1 and 2). The front end 11 of the vacuum cleaner head 10 forms the trailing edge, and the rear end 12 forms the leading edge, when the vacuum cleaner head 10 is pushed in a rearwards direction (right-to-left in FIGS. 1 and 2). It will be understood that the vacuum cleaner head 10 is bi-directional, and so the terms 'forwards' and 'rearwards' may be used for descriptive purposes only.

The vacuum cleaner head 10 has a first roller 20 and a second roller 30. The first and second rollers 20, 30 are rotatably mounted in a housing 40. The rollers 20, 30 are positionable against a surface to be cleaned 60. The first roller 20 is the front roller disposed proximate to the front end 11 of the vacuum cleaner head 10. The second roller 30 is the rear roller disposed proximate to the rear end 12 of the vacuum cleaner head 10.

The housing 40 has an outer shell 41. The housing 40 has an upper wall 42 and a peripheral side wall 43. The peripheral side wall 43 distends from the upper wall 42. The housing 40 has an open lower end 45. The open lower end 45 is defined by a rim 44 of the side wall 43. The housing 40 defines a roller receiving space 46 in which the first and second rollers 20, 30 are received. The first and second rollers 20, 30 protrude from the lower end of the housing 40. That is, the first and second rollers 20, 30 extend from the open lower end 45 of the housing 40 so that they are locatable against the surface to be cleaned 60.

The first and second rollers 20, 30 each have a longitudinal axis. The first roller 20 rotates about the first roller longitudinal axis, and the second roller 30 rotates about the second roller longitudinal axis. The first and second longitudinal axes are parallel, but spaced from, each other. Therefore, the first and second rollers 20, 30 rotate parallel to each other.

The housing 40 has a suction opening 47. The suction opening 47 is formed at the upper end of the housing 40. The suction opening 47 communicates the roller receiving space 46 in the housing 40 with a suction arrangement (not shown) for causing a vacuum. The suction arrangement is connected to the suction opening 47 via a suction passageway. The suction passageway is formed by a tubular section 48 of the housing and a hose (not shown). However, alternative arrangements are envisaged.

A vacuum extraction zone 49 is defined in the housing 40. The vacuum extraction zone 49 is defined between the suction opening 47 and the first and second rollers 20, 30. Upon operation of the vacuum cleaner, an air flow is formed through the vacuum extraction zone 49 to the suction opening 47. Therefore, the vacuum extraction zone 49 defines an air path to the suction opening. The vacuum extraction zone 49 is an area in which detritus disposed in the zone will be drawn from the zone and through the suction opening 47, during operation.

The housing 40 has a roller support 50. The roller support 50 is configured to mount the first and second rollers 20, 30 in the housing 40. The roller support 50 extends in the housing 40 from the upper wall 42 of the housing 40, although it will be understood that alternative arrangements are possible.

The first roller 20 is elongate. The first roller 20 has a first roller body 21. The first roller body 21 is rotatably mounted to a first shaft 22. The first shaft 22 defines the first roller longitudinal axis. The first roller body 21 is therefore able to rotate around the first shaft 22 about the first roller longitudinal axis. The first shaft 22 is mounted to the housing 40. The first roller body 21 has first and second body sections 23, 24. The first and second body sections 23, 24 are spaced from each other, and a mid-section 22*a* of the first shaft 22 connects the two body sections 23, 24 to each other.

The first shaft 22 is mounted to the roller support 50 at the mid-section 22*a*. In one embodiment, the first shaft 22 is separated into left and right portions which are rotatable independently of each other. With this arrangement it is possible to mount the first roller 20 in the housing at one support point only. The first roller 20 is mounted away from its free ends 25. By providing the first roller body 21 with two body sections 23, 24, the first shaft 22 is able to be mounted to the roller support 50.

Each free end 25 of the first roller 20 extends from the side wall 43 of the housing 40. The side wall 43 has roller apertures 51 (refer to FIGS. 3 and 4) corresponding to each free end 25 of the first roller 20 so that the free ends 25 protrude therethrough. The longitudinal length of the first roller 20 is greater than the width of the housing 40 between left and right sides of the side wall 43. The free ends 25 of the first roller 20 protruding from the housing 40 provide for the vacuum cleaner head 10 to clean up to upstanding features on the surface to be cleaned 60, for example a wall. By mounting the first roller 20 to the support 50 at the mid-section 22*a*, the need to mount the first roller 20 at its ends is removed. In an alternative arrangement, the first roller 20 does not extend through the side wall 43 of the housing 40. In such an embodiment, the roller 20 may be mounted to the support 50 at each end 25.

The first roller 20 is configured to rotate about the first roller longitudinal axis in one direction only. The first roller 20 is configured to rotate freely in one direction and is prevented from rotating in the opposite direction. The first roller 20 rotates inwardly. That is, the first roller body 21 is rotatable towards the middle of the housing 40 when viewed from below.

The first roller 20 is configured to rotate when the vacuum cleaner head 10 is urged in its forwards direction over the surface to be cleaned 60, that is the front end 11 forms the leading edge. When the vacuum cleaner head 10 is urged in the forwards direction, the first roller 20 is the leading roller and the second roller 30 is the trailing roller. The first roller 20 is configured to be prevented from rotating when the head is urged in its rearwards direction over the surface to be cleaned 60, that is the rear end 12 forms the leading edge.

A roller rotation restriction mechanism allows the first roller 20 to rotate freely in one direction, but prevents rotation in the opposite direction. The roller rotation restriction mechanism comprises a first roller rotation restriction unit, acting as a first one-way rotation unit. The first roller rotation restriction unit acts on the first roller 20, as will become apparent hereinafter.

Although in the above embodiment, the first roller body 21 is rotatable about the first shaft 22, and the first shaft 22 is fixedly mounted to the housing 40, it will be understood that alternative embodiments are envisaged. An advantage of the first roller body 21 being rotatable about the first shaft 22 is that the first and second body sections 23, 24 may be rotatable relative to each other. In one embodiment the first roller body 21 is fixedly mounted to the first shaft 22, and the first shaft 22 is rotatably mounted to the housing 40. In such an embodiment, the first shaft 22 is rotatably mounted to the support 50.

The first roller 20 has an outer surface 26. The first roller outer surface 26 is cylindrical. The first roller outer surface 26 acts as a contact surface for contacting the surface to be cleaned 60. The outer surface 26 of the first roller 20 is formed by an outer layer 27. The outer layer 27 of the first roller 20 is absorbent. The first roller outer layer 27 is fibrous. An inner layer (not shown) of the first roller 20 below the first roller outer layer 27 is resilient. The resilient inner layer may be omitted, and the first roller inner layer may be rigid. The first roller outer layer 27 extends around the free ends 25 of the first roller 20. The outer layer 27 may be porous and the absorbent section of the first roller 20 may be the or another inner layer. Therefore, the first roller 20 is resilient, fibrous and configured to retain water. However, it will be understood that one or more of these properties may be omitted. For example, the first roller outer layer 27 may be formed from a porous sponge material.

The second roller 30 is elongate. The second roller 30 has a second roller body 31. The second roller body 31 is rotatably mounted to a second shaft 32. The second shaft 32 defines the second roller longitudinal axis. The second roller body 31 is therefore able to rotate around the second shaft 32 about the second roller longitudinal axis. The second shaft 32 is mounted to the housing 40. The second shaft 32 mounting the second roller 30 is spaced from the first shaft 31 mounting the second roller 30. The second roller body 31 has first and second body sections 33, 34. The first and second body sections 33, 34 are spaced from each other, and a mid-section 32*a* of the second shaft 32 connects the two body sections 33, 34 to each other.

The second shaft 32 is mounted to the roller support 50 at the mid-section 32*a*. With this arrangement it is possible to mount the second roller 30 in the housing at one support point only. The second roller 30 is mounted away from its free ends 35. By providing the second roller body 31 with two body sections 33, 34, the second shaft 32 is able to be mounted to the roller support 50.

Each free end 35 of the second roller 30 extends from the side wall 43 of the housing 40. The side wall 43 has roller apertures 51 corresponding to each free end 35 of the second roller 30 so that the free ends 35 protrude therethrough. The longitudinal length of the second roller 30 is greater than the width of the housing 40 between left and right sides of the side wall 43. The free ends 35 of the second roller 30 protruding from the housing 40 provide for the vacuum cleaner head 10 to clean up to upstanding features on the surface to be cleaned 60, for example a wall. By mounting the second roller 30 to the support 50 at the mid-section 32*a*, the need to mount the second roller 30 at its ends is removed. In an alternative arrangement, the second roller 30 does not extend through the side wall 43 of the housing 40. In such an embodiment, the second roller 30 may be mounted to the support 50 at each end 35.

The second roller 30 is configured to rotate about the second roller longitudinal axis in one direction only. The second roller 30 is configured to rotate freely in one direction and is prevented from rotating in the opposite direction. The second roller 30 rotates inwardly. That is, the second roller body 31 is rotatable towards the middle of the housing 40 when viewed from below. The second roller 30 is configured to be rotatable in the opposite direction to the first roller 20.

The second roller 30 is configured to rotate when the vacuum cleaner head 10 is urged in its rearwards direction over the surface to be cleaned 60, that is the rear end 12 forms the leading edge, and is configured to be prevented from rotating when the vacuum cleaner head 10 is urged in its forwards direction over the surface to be cleaned 60, that is the front end 11 forms the leading edge.

The roller rotation restriction mechanism allows the second roller 30 to rotate freely in one direction but prevents rotation in the opposite direction. The roller rotation restriction mechanism comprises a second roller rotation restriction unit, acting as a second one-way rotation unit. The second roller rotation restriction unit acts on the first roller 20, as will become apparent hereinafter.

Although in the above embodiment the second roller body 31 is rotatable about the second shaft 32, and the second shaft 32 is fixedly mounted to the housing 40, it will be understood that alternative embodiments are envisaged. An advantage of the second roller body 31 being rotatable about the second shaft 32 is that the first and second body sections 33, 34 may be rotatable relative to each other. In one embodiment the second roller body 31 is fixedly mounted to the second shaft 32, and the second shaft 32 is rotatably mounted to the housing 40. In such an embodiment, the second shaft 32 is rotatably mounted to the support 50.

The second roller 30 has an outer surface 36. The second roller outer surface 36 is cylindrical. The second roller outer surface 36 acts as a contact surface for contacting the surface to be cleaned 60. The second roller outer surface 36 is formed by an outer layer 37. The outer layer 37 of the second roller 30 is absorbent. The second roller outer layer 37 is fibrous. An inner layer (not shown) of the second roller 30 below the second roller outer layer 37 is resilient. The resilient inner layer of the second roller 30 may be omitted, and the second roller inner layer may be rigid. The second roller outer layer 37 extends around the free ends 35 of the second roller 30. The second roller outer layer 37 may be porous and the absorbent section of the second roller 30 may be the or another inner layer.

Therefore, the second roller 30 is resilient, fibrous and configured to retain water. However, it will be understood that one or more of these properties may be omitted. The arrangement of the second roller 30 may differ from the arrangement of the first roller 20 such that different cleaning properties are effected to a surface to be cleaned 60 in dependence on whether the vacuum cleaner head 10 is urged in a forwards or rearwards direction. For example, the second roller outer layer 37 may be formed from a porous sponge material.

The vacuum cleaner head 10 has a detritus removal arrangement 70. The detritus removal arrangement 70 has a first roller detritus removal unit 71. The first detritus removal unit 71 is configured to act on the first roller 20. The detritus removal arrangement 70 has a second roller detritus removal unit 72. The second detritus removal unit 72 is configured to act on the second roller 30. The first and second detritus removal units 71, 72 may be integrally formed.

The first and second detritus removal units 71, 72 are disposed at the vacuum extraction zone 49. The first and second detritus removal units 71, 72 each have bristles 73 which act on the corresponding roller 20, 30. The bristles 73 act as resilient elements. The bristles 73 are supported in a mount 74. The mount 74 is on the housing 40. Tips 75 of the bristles 73 form free ends of the bristles 73 which locate against the outer surface 26, 36 of the corresponding roller 20, 30. The bristles 73 act on the outer surface 26, 36 of the corresponding first and second roller 20, 30 and cause the fibers of the outer layer 27, 37 to compress as the bristles 73 pass over the corresponding outer surface 26, 27. The bristles 73 brush the outer layer 27, 37 of the corresponding first and second rollers 20, 30.

The alignment of the bristles 73 is in the direction of rotation. That is, the movement of the outer surface 26, 36 of the corresponding first and second roller 20 relative to the bristles 73 is in the direction of the tips 75 of the bristles 73. This helps to minimize detritus collating in the first and second detritus removal units 71, 72. Although bristles 73 are used as resilient elements, it will be anticipated that alternative arrangements are possible. For example, flaps (not shown) may be used.

In the present embodiment, the detritus removal arrangement 70 also acts as the roller rotation restriction mechanism. The first and second detritus removal units 71, 72 act as the first and second roller rotation restriction units respectively. The alignment of the bristles 73 acting on each of the first and second rollers 20, 30 provides for the outer surface of each of the rollers 20, 30 to slide in the direction of alignment of the bristles 73, but restricts rotation in the opposing direction. That is, tips 75 of the bristles 73 act on the first and second rollers 20, 30 to provide a restricting force on the first and second rollers 20, 30.

However, an alternative roller rotation restriction mechanism (not shown) may be used. For example, in another arrangement, a ratchet mechanism (not shown) acts as the roller rotation restriction mechanism. In such an embodiment, a first ratchet mechanism unit allows the first roller 20 to rotate freely in one direction but prevents rotation in the opposite direction. Similarly, a second ratchet mechanism unit allows the second roller 30 to rotate freely in one direction but prevents rotation in the opposite direction.

The vacuum cleaner head 10 has a liquid removal arrangement 80. The liquid removal arrangement 80 has a first roller liquid removal unit 81. The first liquid removal unit 81 is configured to act on the first roller 20. The liquid removal arrangement 80 has a second roller liquid removal unit 82. The second liquid removal unit 82 is configured to act on the second roller 30. The first and second liquid removal units 81, 82 may be integrally formed.

The first and second liquid removal units 81, 82 are in the housing 40. The first and second liquid removal units 81, 82 each have a resilient flap 83. The resilient flaps 83 are formed from rubber. The resilient flaps 83 are mounted on the housing 40. Free ends 84 of the resilient flaps 83 locate against the outer surface 26, 36 of the corresponding roller 20, 30. The first and second liquid removal units 81, 82 are disposed after the first and second detritus removal units 71, 72 in the direction of rotation of each roller 20, 30. That is, each section of roller 20, 30 is acted on by the relevant first and second detritus removal unit 71, 72 prior to being acted on by the relevant first and second liquid removal unit 81, 82 when each roller 20, 30 is rotated. The free ends 84 of the resilient flaps 83 act on the outer surface 26, 36 of the corresponding first and second roller 20, 30 and cause liquid absorbed by the relevant roller 20, 30 to be urged from the roller 20, 30. The resilient flaps 83 form a seal between the corresponding first and second rollers 20, 30 and the housing 40. Therefore, the pressure reduction in the housing 40 is maximized. This helps to maximize the vacuum to draw liquid from the first and second rollers 20, 30, which will in turn flow to the suction opening 47.

The alignment of each resilient flap 83 is in the direction of rotation of the corresponding first and second roller 20, 30. That is, the movement of the outer surface 26, 36 of the corresponding first and second roller 20 relative to the resilient flap 83 is in the direction of the free end 84 of the resilient flap 83. The free end 84 of each resilient flap 83 distends downwardly. This creates a channel 86 between the resilient flap 83 and the corresponding roller 20, 30 in which liquid can collate. Therefore, the outer surface 26, 36 of the corresponding roller 20, 30 may be rinsed by liquid in the channel 86 as it rotates past the channel 86. Although one resilient flap 83 is used per roller, it will be anticipated that alternative arrangements are possible.

The vacuum cleaner head 10 has a liquid dispenser 90. The liquid dispenser 90 is configured to dispense a liquid onto the surface to be cleaned 60. In the present embodiment the liquid dispenser 90 is a spray. The liquid dispenser 90 communicates with a liquid container (not shown). The liquid dispenser 90 receives liquid, such as water, from the water container. The liquid dispenser 90 is disposed at the front end 11 of the vacuum cleaner head 10. The liquid dispenser 90 is operable in response to user input. Therefore, the user is able to easily control the quantity of water supplied to the surface. Alternatively, the liquid dispenser 90 may be configured to operate when the vacuum cleaner head 10 is urged in a forwards direction. In one embodiment, the liquid dispenser 90 is configured to supply liquid directly to at least one of the rollers 20, 30. The liquid dispenser 90 may be omitted.

Figure 2:
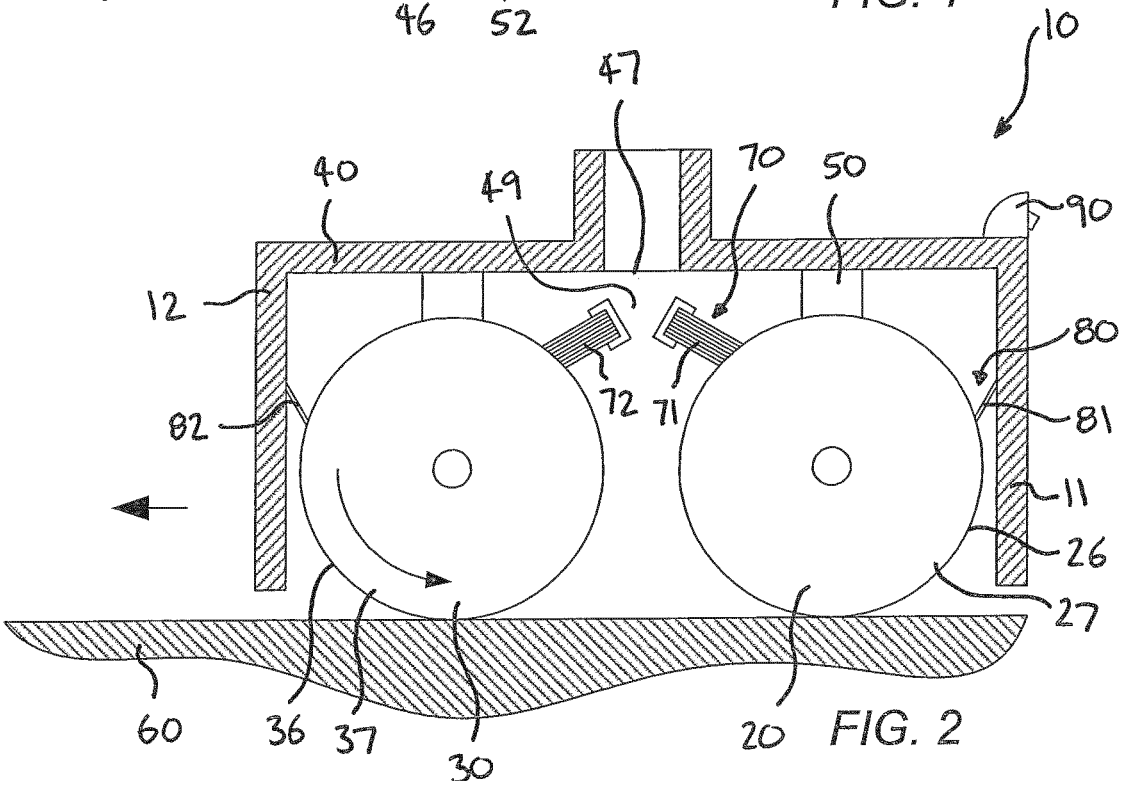
FIG. 2 shows an illustrative partial cutaway side view of the vacuum cleaner head of FIG. 1 urged in a second opposing direction along the surface to be cleaned, with a section of the housing omitted.
Figure 3:
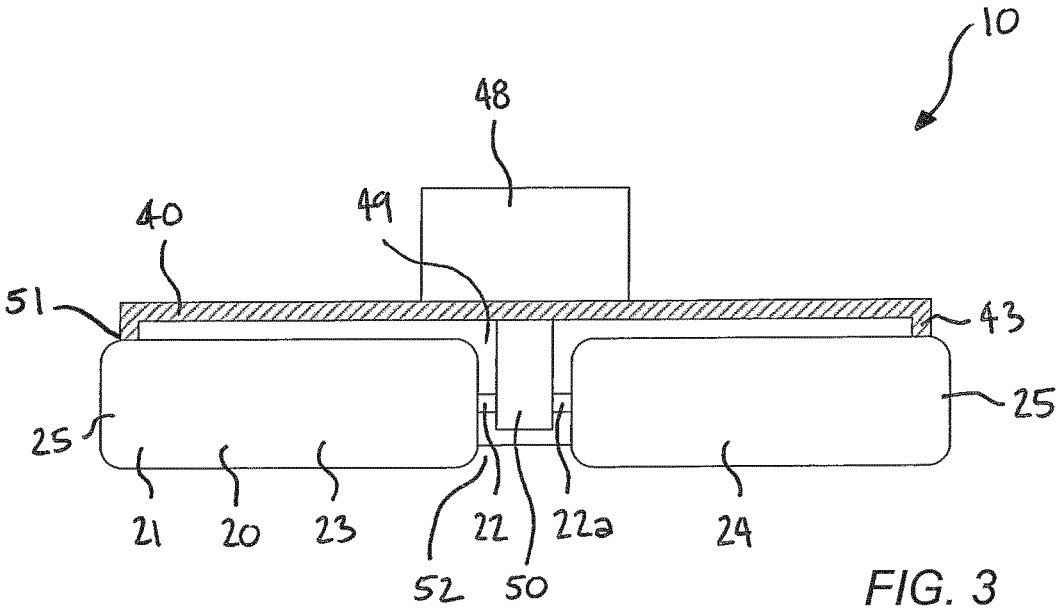
FIG. 3 shows an illustrative partial cutaway front view of the vacuum cleaner head of FIG. 1 with a section of the housing omitted.
Figure 4:
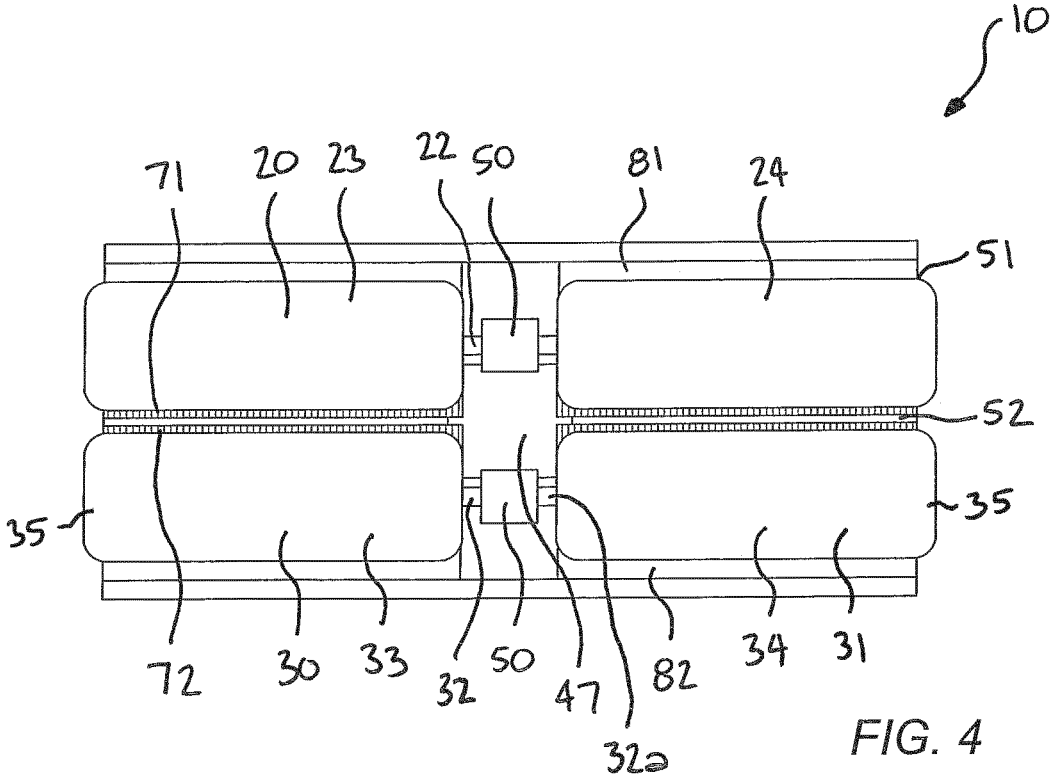
FIG. 4 shows an illustrative plan view from below of the vacuum cleaner head of FIG. 1.

Operation of the vacuum cleaner head 10 will now be described, in particular with reference to FIGS. 1 and 2.

The vacuum cleaner head 10 is disposed against the surface to be cleaned 60. The first and second rollers 20, 30 are disposed against the surface to be cleaned 60. The user operates the vacuum cleaner to generate a suction force through the suction opening 47 in the vacuum cleaner head 10. The vacuum cleaner head 10 is initially in a stationary condition. That is, the vacuum cleaner head 10 is not urged in either of a forwards or rearwards direction. The first and second roller 20, 30 are stationary in this condition and so do not rotate.

The user applies an urging force to the vacuum cleaner head 10. If the user applies a forwards action to the vacuum cleaner head 10, the vacuum cleaner head 10 is urged to move in a forwards direction. That is, the front end 11 of the vacuum cleaner head 10 forms the leading edge, and the rear end 12 forms the trailing edge, when the vacuum cleaner head 10 is pushed in the forwards direction (left-to-right in FIG. 1). The first roller 20 forms the leading roller and the second roller 30 forms the trailing roller in this condition. The first roller 20 is free to rotate in the direction of travel, and rotates as it moves over the surface to be cleaned 60 (as shown by the arrow in FIG. 1). This means that it is not necessary to apply any driving force by a drive means to additionally rotate the first and second rollers 20. The second roller 30 is prevented from rotating due to the roller rotation restriction mechanism acting on the second roller 30. Therefore, the second roller 30 slides over the surface to be cleaned 60 when urged in the forwards direction.

As the vacuum cleaner head 10 moves in the forwards direction 10, the first roller 20 rotates over the surface to be cleaned 60. The first roller 20 therefore moves over detritus and/or liquid on the surface to be cleaned 60. Detritus and/or liquid on the surface to be cleaned 60 is picked-up by the outer layer 27 of the first roller 20. Detritus is picked-up by the fibers of the first roller 20. Detritus that is not picked-up by the first roller 20 as it passes over the detritus is received in a detritus receiving space 52 defined between the first and second rollers 20, 30. Similarly, liquid is absorbed by the first roller 20. Any liquid that is not picked-up by the first roller 20 is received in a detritus receiving space 52 defined between the first and second rollers 20, 30. Loose detritus may also be caught by the created airstream between the rollers, and be drawn to the vacuum extraction zone between the rollers 20, 30. In one embodiment, apertures (not shown) are formed in the outer shell 41 of the housing 40.

Detritus and/or liquid picked-up by the first roller 20 is transported by the rotational motion of the first roller 20 as the vacuum cleaner head 10 is urged in the forwards direction. The detritus and/or liquid is guided towards the vacuum extraction zone 49. Due to the suction applied in housing 40, detritus and/or liquid is drawn from the outer surface 26 of the first roller 20 as the outer surface 26 of the first roller 20 rotates. As the first roller 20 rotates, the outer surface 26 of the first roller 20 slides past the detritus removal unit 71. The bristles 73 act on the outer surface 26 of the first roller 20 and cause the first roller outer layer 27 to be compressed. That is, the bristles 73 deflect the fibers of the outer layer 27. The bristles 73 also brush the fibers to dislodge detritus particles. As the fibers move past the bristles 73, they are able to deflect back to their neutral position, and so impart an urging force on the detritus carried by the fibers. This detritus is therefore urged into the vacuum extraction zone 49 and is carried through the suction opening 47 by the generated airflow. The bristles 73 act as pile-flicking elements.

As the first roller 20 further rotates, the section of the outer surface 26 of the first roller 20 that was in contact with the detritus removal arrangement 70 then comes into contact with the liquid removal arrangement 80. As the first roller 20 rotates, the outer surface 26 of the first roller 20 slides past the first liquid removal unit 81. The free end 84 of the resilient flap 83 acts on the outer surface 26 of the first roller 20 and causes a compressive action. The absorbent layer of the first roller 20 is urged to compress such that liquid is restricted from moving past a radial line extending from the free end 84 of the resilient flap 83 due to the applied compressive force. This liquid is then transported to the suction outlet 49 to be removed from the vacuum cleaner head 10. Any liquid that accumulates in the channel 86 defined between the outer surface 26 of the first roller 20 and the resilient flap 83 will act to clean the roller 20 as the outer surface 26 of the first roller 20 slides past the liquid removal arrangement 80.

Detritus and/or liquid in the detritus receiving space 52 that is not picked-up by the first roller 20 will then come into contact with the second roller 30 as the vacuum cleaner head 10 continues to be moved. Detritus and liquid will accumulate at the contact point of the second roller 30 and the surface to be cleaned 60, but is prevented from moving past the second roller 30 due to the wiping action of the second roller 30 acting as the trailing roller. The second roller 30 is prevented from rotating when acting as the trailing roller and so will slide along the surface to be cleaned 60. Therefore, detritus and/or liquid is accumulated by the vacuum cleaner head 10 and is restricted from leaving the trailing end of the vacuum cleaner head 10. Any liquid contacting the second roller 30 may be absorbed by the second roller 30 and will be guided towards the vacuum extraction section 49 as the second roller 30 rotates when the head is moved in the rearwards direction. The liquid may also flow to the vacuum extraction section 49 due to the vacuum created on the underside of the vacuum cleaner head 10.

If the user applies a rearwards action to the vacuum cleaner head 10, the head is urged to move in a rearwards direction. That is, the rear end 12 of the vacuum cleaner head 10 forms the leading edge, and the front end 11 of the vacuum cleaner head 10 forms the trailing edge, when the vacuum cleaner head 10 is pushed in a rearwards direction (right-to-left in FIGS. 1 and 2). The second roller 30 forms the leading roller and the first roller 20 forms the trailing roller in this condition. The second roller 30 is free to rotate in the direction of travel, and rotates as it moves over the surface to be cleaned 60 (as shown by the arrow in FIG. 2). The first roller 20 is prevented from rotating due to the first ratchet mechanism (not shown) acting as a roller rotation restriction unit. Therefore, the first roller 20 slides over the surface to be cleaned 60 when urged in the rearwards direction.

Operation of the vacuum cleaner head 10 when moved in the rearwards direction is generally the same as when the vacuum cleaner head 10 is moved in the forwards direction, but with the second roller 30 acting as the leading roller and rotating together with the movement of the vacuum cleaner head 10, and the first roller 20 acting as the trailing roller and not rotating. That is, the actions of the first and second rollers 20, 30 are reversed between the forwards and rearwards directions.

However, detritus and/or liquid that had previously accumulated at the second roller 30 when the second roller 30 was restricted from rotating will be picked-up by the second roller 30 and rotate therewith. Any remaining detritus and/or liquid is retained in the detritus receiving space 52 and abuts against the first roller 20 as the vacuum cleaner head 10 is further moved. Therefore, detritus and/or liquid received in the detritus receiving space 52 is prevented from moving past the first and second rollers 20, 30. This helps to promote cleaning of the surface to be cleaned. Any detritus that cannot be picked-up by the rollers 20, 30 will accumulate in the detritus receiving space 52 due to the wiping action of the roller 20, 30 acting as the trailing roller in each direction and so is easily cleared by the user following use of the vacuum cleaner head 10.

If there are stains on the surface to be cleaned, then the leading roller is able to wet them, and the trailing roller wipes over them. The microslip of the leading roller also aids in the removal of stains.

Although in the present embodiment the detritus removal arrangement 70 and liquid removal arrangement 80 are independent of each other, it will be understood that in an alternative arrangement the detritus removal arrangement 70 and liquid removal arrangement 80 are combined. With such an embodiment, the arrangement of the vacuum cleaner head 10 is simplified.

The sliding motion of the first and second rollers 20, 30 acting as the trailing roller helps to dislodge detritus that is adhered to the surface to be cleaned. Also, as the rollers 20, 30 are absorbent, they act to dampen the surface to be cleaned 60 as they are slid over the surface to be cleaned 60 and so wipe the surface to be cleaned 60.

Although the above described embodiments include the detritus removal arrangement and the liquid removal arrangement, it will be understood that in one embodiment one or both of the detritus removal arrangement and liquid removal arrangement is omitted.

In one embodiment, the detritus removal arrangement is omitted. The detritus in such an embodiment is removed from the rollers 20, 30 and drawn through the suction opening 47 by the suction applied at the suction extraction zone 49. An advantage of the detritus removal arrangement 70 is that an urging force is applied to each roller 20, 30 to encourage the detritus to separate from the rollers 20, 30. Furthermore, the resilience of the bristles 73 causes the released detritus to be urged away from the rollers 20, 30 and into the vacuum extraction zone 49. Therefore, the suction force may be reduced.

In one embodiment, the liquid removal arrangement is omitted. Liquid picked-up by the first and second rollers is drawn from the through the suction opening 47 by the suction applied at the suction extraction zone 49. An advantage of the liquid removal arrangement 80 is that the efficiency of liquid extraction from the first and second rollers 20, 30 may be maximized. Furthermore, the liquid removal arrangement 80 imparts an urging force on the rollers 20, 30.

It should be noted that the above-mentioned embodiments illustrate rather than limit the invention, and that those skilled in the art will be able to design many alternative embodiments without departing from the scope of the appended claims. It will be appreciated that the term "comprising" does not exclude other elements or steps and that the indefinite article "a" or "an" does not exclude a plurality. The mere fact that certain measures are recited in mutually different dependent claims does not indicate that a combination of these measures cannot be used to an advantage. Any reference signs in the claims should not be construed as limiting the scope of the claims.

The invention claimed is:

1. A vacuum cleaner head comprising:

a housing having a vacuum extraction zone; and first and second rollers configured to locate against a surface to be cleaned, each of the first and second rollers being configured to pick-up detritus from the surface to be cleaned and carry the detritus to the vacuum extraction zone in the housing when they rotate and move over the surface to be cleaned, wherein the first roller is rotatable due to moving along the surface to be cleaned in a first direction and restricted from rotating when moved in an opposing second direction, and wherein the second roller is rotatable due to moving along the surface in the second direction and restricted from rotating when moved in the first direction.

2. The vacuum cleaner head according to claim 1, further comprising a detritus removal arrangement in the housing configured to act on at least one of the first and second rollers to remove the detritus from the at least one of the first and second rollers to the vacuum extraction zone as the at least one of the first and second rollers rotates.

3. The vacuum cleaner head according to claim 2, wherein the detritus removal arrangement is configured to remove of dust and/or particles from the at least one of the first and second rollers as the at least one of the first and second roller rotates.

4. The vacuum cleaner head according to claim 3, wherein the detritus removal arrangement comprises a plurality of resilient elements configured to act on the at least one of the first and second rollers.

5. The vacuum cleaner head according to claim 4, wherein the plurality of resilient elements are bristles.

6. The vacuum cleaner head according to claim 2, further comprising a liquid removal arrangement configured to act on at least one of the first and second rollers to remove liquid from the at least one of the first and second rollers to the vacuum extraction zone.

7. The vacuum cleaner head according to claim 6, wherein the liquid removal arrangement comprises a resilient flap configured to act on the at least one of the first and second rollers.

8. The vacuum cleaner head according to claim 6, wherein the detritus removal arrangement and the liquid removal arrangement are integrally formed.

9. The vacuum cleaner head according to claim 1, wherein a layer of the at least one of the first and second rollers is fibrous.

10. The vacuum cleaner head according to claim 1 wherein a layer of at least one of the first and second rollers is configured to retain liquid.

11. The vacuum cleaner head according to claim 1 wherein at least a section of at least one of the first and second rollers is resilient.

12. The vacuum cleaner head according to claim 1, wherein a support for supporting at least one of the first and second rollers is spaced from at least one end of the at least one of the first and second rollers.

13. The vacuum cleaner head according to claim 1, further comprising a liquid dispenser to dispense a liquid onto the surface to be cleaned and/or at least one of the first and second rollers.

14. A vacuum cleaner comprising a vacuum cleaner head according to claim 1.

15. A vacuum cleaner head comprising:

a first roller configured to rotate when moved along a surface to be cleaned in a first direction to pick-up first detritus from the surface to be cleaned, and to be restricted from rotating when moved along the surface to be cleaned in a second direction;

a second roller configured to rotate when moved along the surface to be cleaned in the second direction to pick-up second detritus from the surface to be cleaned, and to be restricted from rotating when moved along the surface to be cleaned in the first direction;

first bristles in contact with the first roller, and configured to remove the first detritus from the first roller when the first roller is rotating, such that the removed first detritus is directed to a suction opening via air flow formed through a vacuum extraction zone located between the first and second rollers; and second bristles in contact with the second roller when the second roller is rotating, and configured to remove the second detritus from the second roller such that the removed second detritus is directed to the suction opening via the air flow formed through the vacuum extraction zone.

16. The vacuum cleaner head according to claim 15, further comprising:

a receiving space defined between the first and second rollers, wherein detritus that is not picked-up by the first roller or the second roller, after the first roller or the second roller passes over the detritus, is directed to the suction opening via the air flow formed through the vacuum extraction zone.

17. The vacuum cleaner head according to claim 15, further comprising:

a first liquid removal unit configured to act on the first roller to remove liquid from the first roller when the first roller is rotating; and a second liquid removal unit configured to act on the first roller to remove of liquid from the second roller when the second roller is rotating.

18. The vacuum cleaner head according to claim 17, wherein at least one of the first or second liquid removal units comprises a resilient flap configured to act on the at least one of the first and second rollers.

19. The vacuum cleaner head according to claim 18, wherein the resilient flap is configured to form a seal between the first and second rollers and a housing of the vacuum cleaner head.

20. The vacuum cleaner head according to claim 15, wherein the first roller and the second roller are each configured to be urged to rotate due to the action of the vacuum cleaner head being moved over the surface to be cleaned.

* * * * *